US010239111B2

(12) United States Patent
Knewtson et al.

(10) Patent No.: US 10,239,111 B2
(45) Date of Patent: Mar. 26, 2019

(54) FEEDBACK-BASED SYSTEM FOR BENDING WIRE AND FORMING SPRINGS

(71) Applicant: L&P PROPERTY MANAGEMENT COMPANY, South Gate, CA (US)

(72) Inventors: Kelly M. Knewtson, Joplin, MO (US); David William McCune, Carthage, MO (US); Travis L. Brummett, Carthage, MO (US); Tyler Kussman, Joplin, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 154 days.

(21) Appl. No.: 15/374,494

(22) Filed: Dec. 9, 2016

(65) Prior Publication Data

US 2018/0161849 A1 Jun. 14, 2018

(51) Int. Cl.
*B21F 35/04* (2006.01)
*B21C 51/00* (2006.01)

(52) U.S. Cl.
CPC ..... *B21F 35/04* (2013.01); *B21C 51/00* (2013.01)

(58) Field of Classification Search
CPC ..... B21D 35/04; B21D 35/00; B21D 11/00; B21D 1/04; B21D 3/00
See application file for complete search history.

(56) References Cited

U.S. PATENT DOCUMENTS

| | | | |
|---|---|---|---|
| 24,557 | A | 6/1859 | Harrison |
| 2,582,576 | A | 1/1952 | Zweyer |
| 2,700,409 | A | 1/1955 | Weiss |
| 5,685,186 | A | 11/1997 | Flemmer |
| 2009/0260411 | A1 | 10/2009 | Knewtson |

OTHER PUBLICATIONS

International Search Report and Written Opinion, dated Feb. 9, 2018 in International Patent Application No. PCT/US2017/062555, 12 pages.

*Primary Examiner* — Teresa M Ekiert
(74) *Attorney, Agent, or Firm* — Shook, Hardy & Bacon L.L.P.

(57) ABSTRACT

Feedback-based systems and methods for bending wire are provided. The systems and methods may allow for modification of wire bending based on feedback received from one or more feedback-generating elements (e.g., image-capturing device(s), computer processing device(s), vision systems, etc.) used for monitoring one or more characteristics of a wire (e.g., shape, size, dimension, angular configuration, etc.) to determine, and provide to various wire-bending components of the system, appropriate modifications to the wire-bending process. Modifications to the wire-bending process may occur in real time without stopping the wire-bending process. Furthermore, a wire may be bent into a sinusoidal wire structure for forming springs for use in various applications.

19 Claims, 16 Drawing Sheets

FIG. 3A
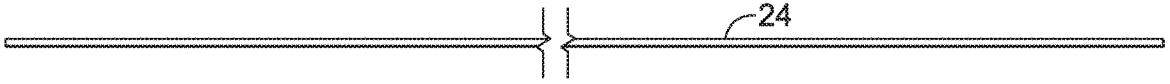
FIG. 3B
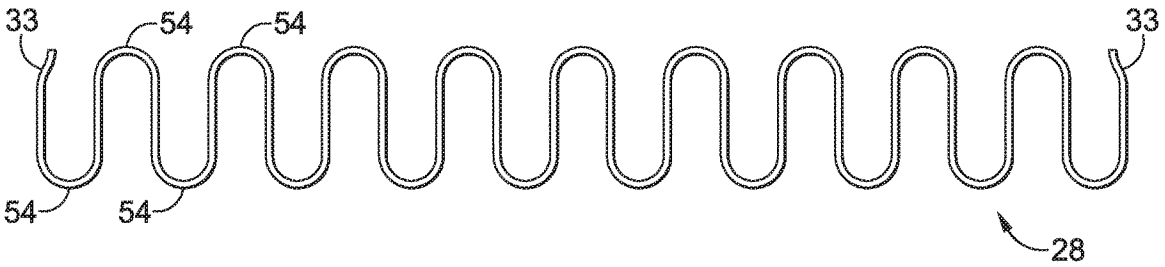
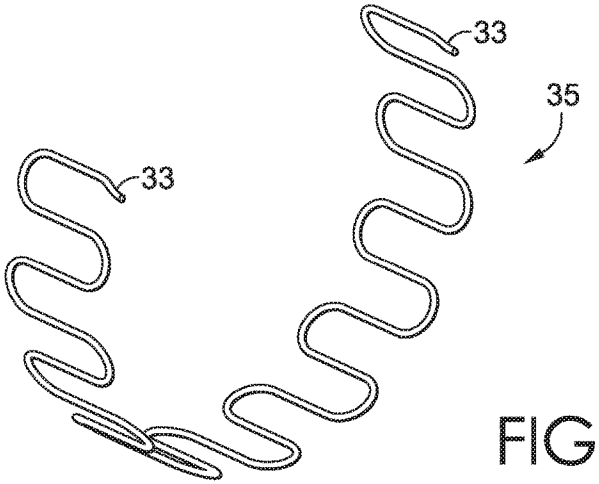
FIG. 3C

FEEDBACK-BASED SYSTEM FOR BENDING WIRE AND FORMING SPRINGS

TECHNICAL FIELD

The field relates to wire-bending, such as for use in forming springs.

BRIEF SUMMARY

A high-level overview of various aspects of the present technology is provided in this section to introduce a selection of concepts that are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, a feedback-based system for bending wire. The system allows for modification of wire bending based on feedback received from one or more sources. For example, the system may include one or more feedback-generating elements (e.g., vision system(s), camera(s), backlight(s), computer processing device(s), etc.) used for monitoring one or more characteristics of a wire (e.g., shape, size, dimension, angular configuration, etc.) to determine, and provide to various wire-bending components of the system, appropriate modifications to the wire-bending process. In some embodiments, modifications to the wire-bending process may occur in real time (e.g., on the fly) without stopping the wire-bending process, potentially increasing efficiency and quality of a resulting wire structure, among other benefits.

In one embodiment of the technology, a feedback-based system for bending wire is provided. The system comprises a wire-bending mechanism configured to bend a wire using continuous oscillation of a wire-bending element to produce a sinusoidal wire structure, a wire-cutting mechanism configured to cut the sinusoidal wire structure into a plurality of sections, and a wire-monitoring component configured to detect a characteristic of the sinusoidal wire structure, determine if the characteristic is within selected limits, and provide an instruction to the wire-bending mechanism to modify the bending of the wire when the characteristic is not within the selected limits in order to modify the characteristic.

In another embodiment of the technology, a feedback-based method of bending wire is provided. The method comprises providing a wire, bending the wire using continuous oscillation of a wire-bending element to produce a sinusoidal wire structure, detecting, using a wire-monitoring component, a characteristic of the sinusoidal wire structure, determining, using the wire-monitoring component, if the characteristic is within selected limits, and providing, using the wire-monitoring component, an instruction to modify the bending of the wire to adjust the characteristic of the sinusoidal wire structure when the characteristic is not within the selected limit(s).

In another embodiment of the technology, a method for feedback-based wire bending is provided. The method comprises providing a wire, providing a wire-bending mechanism comprising a wire-bending element and a retainer tool, and providing a wire-monitoring component comprising one or more image-capturing devices and one or more computer processors communicatively coupled to the one or more image-capturing devices. The method further comprises bending the wire using the wire-bending mechanism to form a sinusoidal wire structure, capturing one or more images of the sinusoidal wire structure or a section thereof using the one or more image-capturing devices, determining if a characteristic of the sinusoidal wire structure or the section thereof depicted in the one or more images is outside of selected limits, and instructing, upon determining that the characteristic is outside of the selected limits, the wire-bending mechanism to modify the bending of the wire to modify the characteristic.

A "wire," as used herein, comprises any structure that can be bent into various shapes or angular geometries using a bending process, and may include, but is not limited to, wires formed from metal (e.g., steel, copper, aluminum, gold, platinum, silver, tungsten, composites thereof, etc.), non-metal (e.g., carbon, polymeric composites, etc.), and composites of metal and non-metal, as well as wound, woven, spun, cut, and/or braided wires and wire structures. A "sinusoidal wire structure," as used herein, comprises any wire that is formed to have a mathematical curve with a continuous oscillation. Different sizes, shapes, and frequencies of sinusoidal curves on a sinusoidal wire structure per unit of measurement are possible and contemplated, and the sinusoidal wire structures depicted herein are intended to be exemplary and non-limiting in nature. Additionally, while many embodiments of the present disclosure discuss sinusoidal-shaped wire structures and variations thereof, monitoring, adjustment, and formation of other wire shapes is also possible and contemplated using the components and methods described herein.

BRIEF DESCRIPTION OF THE DRAWINGS

The present technology is described in detail with reference to the drawing figures, which are intended to be exemplary and non-limiting in nature, wherein:

FIGS. 3A-3C depict a wire, a wire bent into a sinusoidal wire structure, and a spring formed from the sinusoidal wire structure, respectively, in accordance with embodiments of the present technology;

DETAILED DESCRIPTION

Figure 1:
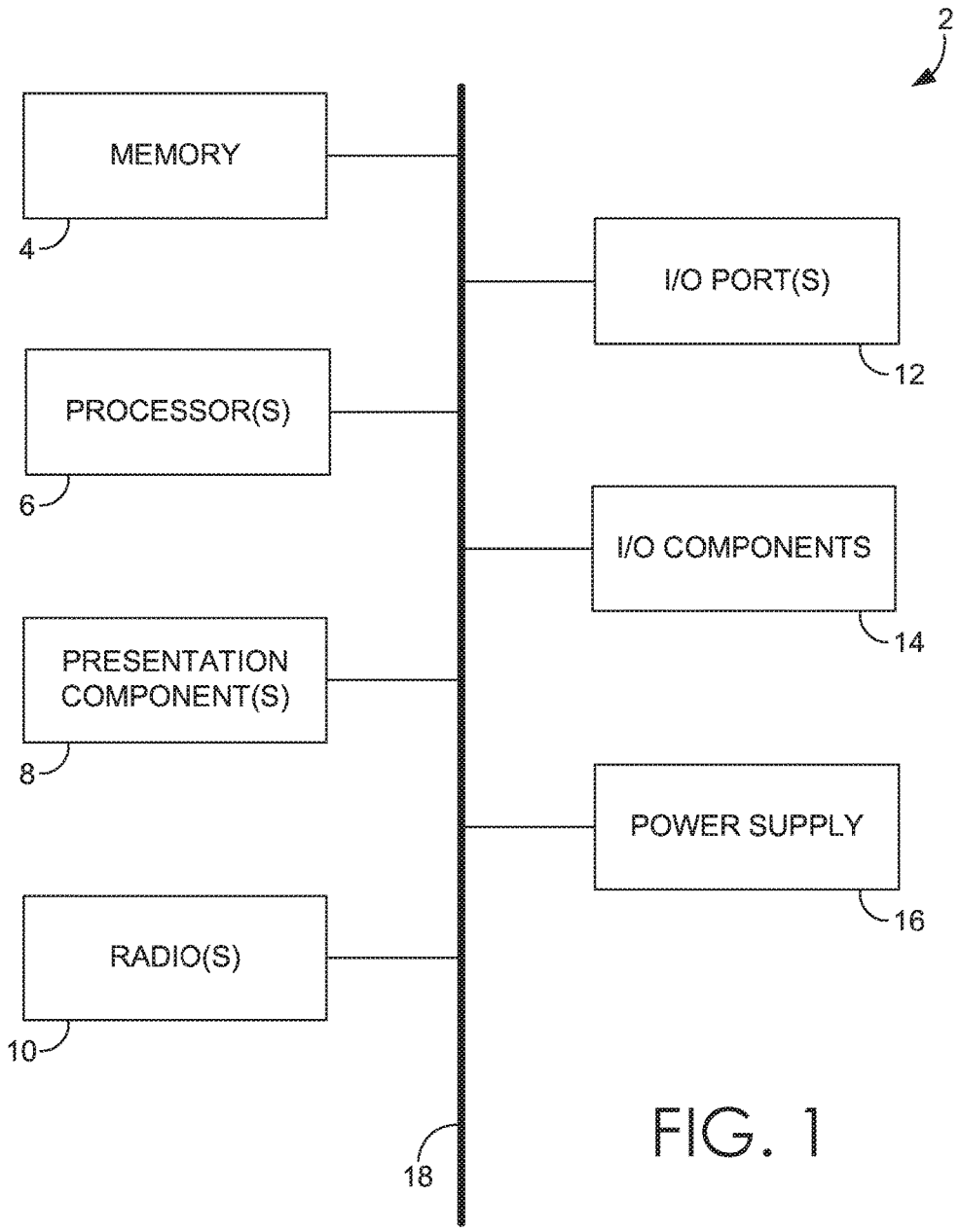
FIG. 1 depicts an exemplary computing environment for use with a feedback-based wire-bending system, in accordance with an embodiment of the present technology.

The subject matter of the present technology is described with specificity in this disclosure to meet statutory requirements. However, the description is not intended to limit the scope hereof. Rather, the claimed subject matter may be embodied in other ways, to include different elements, steps, and/or combinations of elements and/or steps, similar to the ones described in this disclosure, and in conjunction with other present and future technologies. The terms "step" or "block" should not be interpreted as implying any particular order among or between steps of the methods employed unless and except when the order of individual steps or blocks is explicitly described and required.

At a high level, the present technology relates generally to feedback-based systems and methods for bending wire, such as for use in forming springs for various applications (e.g., sofas, beds, other seating, etc.). For example, a wire may be bent in multiple portions to form a sinusoidal-type wire structure. The sinusoidal wire structure may then be cut into sections that can be bent to form individual springs. The sinusoidal wire structure, or a cut section thereof, may be analyzed by a wire-monitoring component to determine if desired characteristic(s) of the sinusoidal wire structure are maintained within selected limits. Feedback from the wire-monitoring component may be used to modify the wire bending to adjust the desired characteristic(s) as needed, including, in some exemplary embodiments, during continuous operation of the wire-bending process. Additionally, various computing components may be used to store and access specific configurations of the wire-bending system that produce specific wire structures, which can be used to instruct components of the wire-bending system to produce the specific wire structures when desired, possibly reducing setup and transition time.

Embodiments of the present technology may be embodied as, among other things, a method, a system, or a computer-program product. Accordingly, the embodiments may take the form of a hardware embodiment, or an embodiment combining software and hardware. A computer-program product that includes computer-useable instructions embodied on one or more computer-readable media may also be used. The present technology may further be implemented as hard-coded into the mechanical design of computing components and/or may be built into an apparatus for bending wire or a computer processor communicatively connected to the same.

Computer-readable media includes volatile media, non-volatile media, removable media, and non-removable media, and includes media readable by a database, a switch, and/or various other network devices. Network switches, routers, and related components are conventional in nature, as are methods of communicating with the same, so further elaboration is not provided here. By way of example, and not limitation, computer-readable media may comprise computer storage media and/or non-transitory communications media.

Computer storage media, or machine-readable media, may include media implemented in any method or technology for storing information. Examples of stored information include computer-useable instructions, data structures, program modules, and/or other data representations. Computer storage media may include, but is not limited to, RAM, ROM, EEPROM, flash memory or other memory technology, CD-ROM, digital versatile discs (DVD), holographic media or other optical disc storage, magnetic cassettes, magnetic tape, magnetic disk storage, and/or other magnetic storage devices. These memory components may store data momentarily, temporarily, and/or permanently, and are not limited to the examples provided in this disclosure.

Turning now to FIG. 1, a block diagram of an exemplary computing device 2 for use in feedback-based wire bending is provided, in accordance with an embodiment of the present technology. It should be noted that although some components depicted in FIG. 1 are shown in the singular, they may be plural. For example, computing device 2 might include multiple processors and/or multiple radios. As shown in FIG. 1, computing device 2 includes a bus 18 that may directly or indirectly couple various components together, including memory(s) 4, processor(s) 6, presentation component(s) 8 (if applicable), radio(s) 10, input/output (I/O) port(s) 12, input/output (I/O) component(s) 14, and power supply 16.

Memory 4 may take the form of the memory components described herein. Thus, further elaboration will not be provided, but it should be noted that memory 4 may include any type of tangible medium that is capable of storing information, such as a database. A database may include any collection of records, data, and/or other information. In one embodiment, memory 4 may include a set of embodied computer-executable instructions that, when executed, facilitate various functions or steps disclosed herein. These embodied instructions will variously be referred to as "instructions" or an "application" for short. Processor 6 may actually be multiple processors that receive instructions and process them accordingly. Presentation component 8 may include a display, a speaker, and/or other components that can present information through visual, auditory, and/or other tactile cues (e.g., a display, a screen, a lamp, a light-emitting diode (LED), a graphical user interface (GUI), or even a lighted keyboard).

Radio 10 may facilitate communication with a network, and may additionally or alternatively facilitate other types of wireless communications, such as Wi-Fi, WiMAX, LTE, and/or other VoIP communications. In various embodiments, the radio 10 may be configured to support multiple technologies, and/or multiple radios may be configured and utilized to support multiple technologies.

Input/output (I/O) ports 12 may take a variety of forms. Exemplary I/O ports may include a USB jack, a stereo jack, an infrared port, a firewire port, and/or other proprietary communications ports. Input/output (I/O) components 14 may comprise one or more keyboards, microphones, speakers, touchscreens, and/or any other item usable to directly or indirectly input data into the computing device 2.

Power supply 16 may include batteries, fuel cells, and/or any other component that may act as a power source to supply power to computing device 2 or to other network components, including through one or more electrical connections or couplings. Power supply 16 may be configured to selectively supply power to different components independently and/or concurrently.

Figure 2:
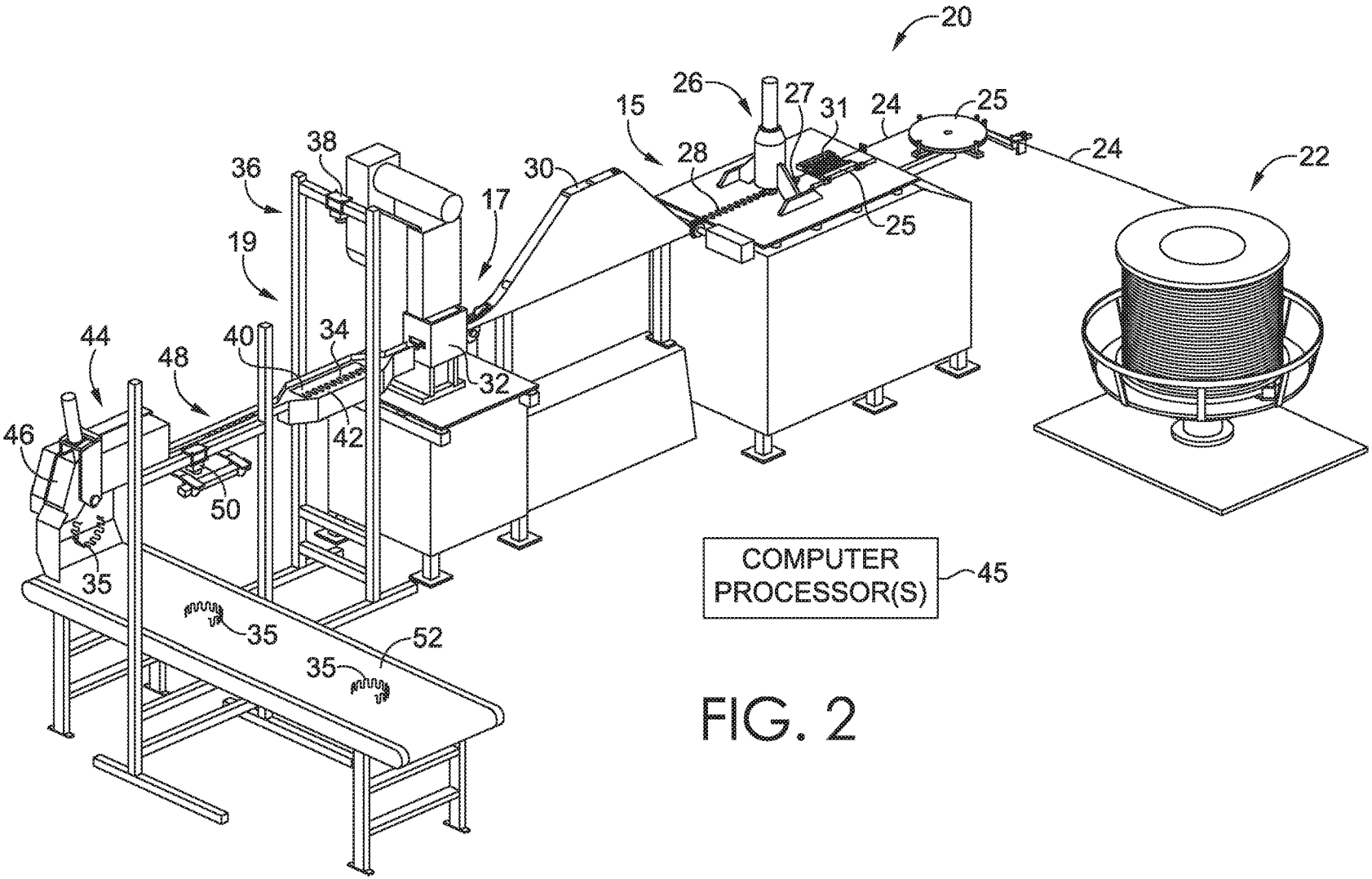
FIG. 2 depicts an exemplary system for feedback-based wire bending, in accordance with an embodiment of the present technology.
Figure 4:
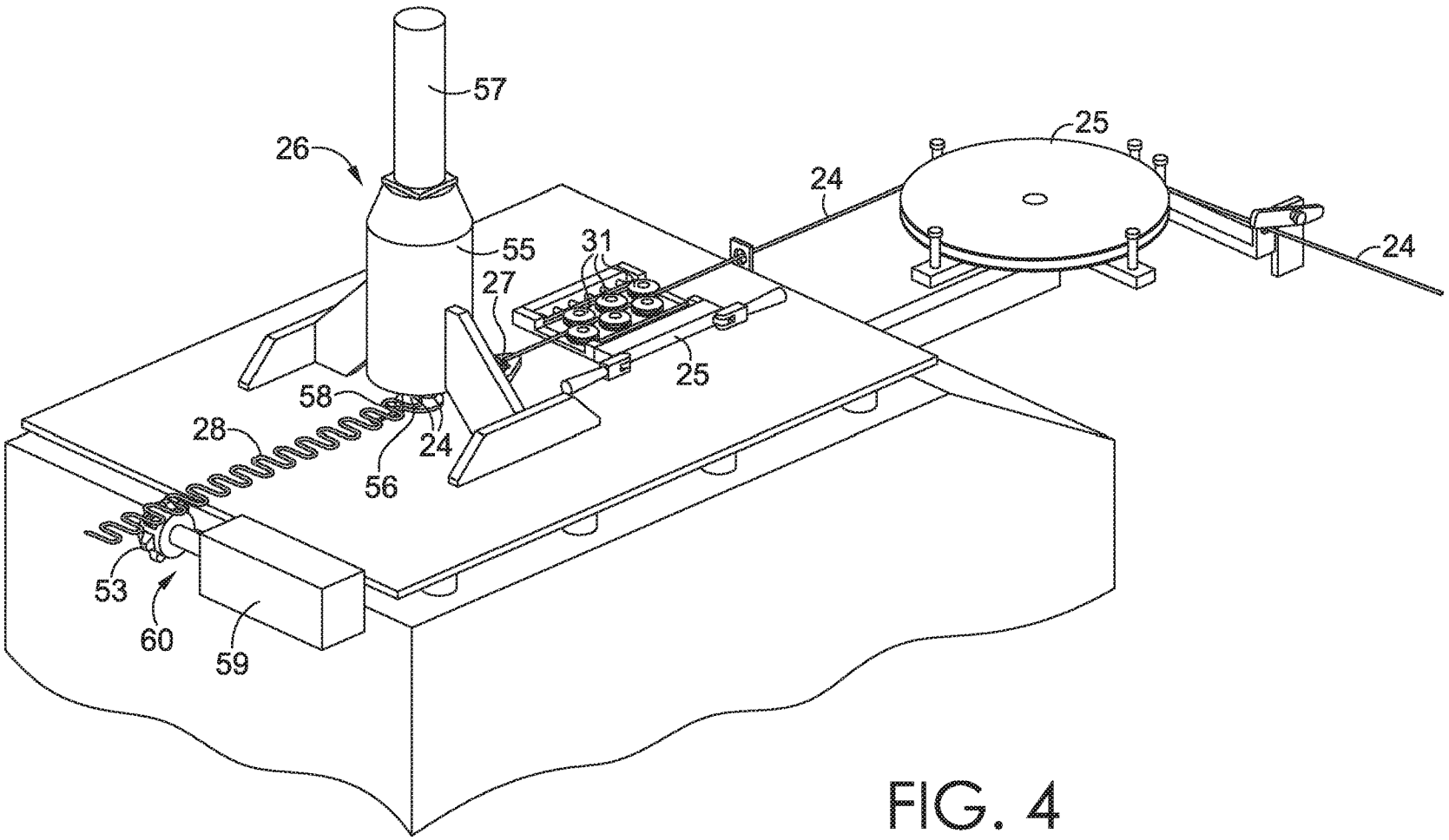
FIG. 4 is an enhanced view of the wire-bending system of FIG. 2, showing a wire-bending mechanism, in accordance with an embodiment of the present technology.

Referring to FIG. 2, an exemplary system 20 for feedback-based wire bending is provided, in accordance with an embodiment of the present technology. The system 20 includes a wire-feeding element 22 which supplies a wire 24, a wire pre-tensioning device 25, a wire-bending mechanism 26, an accumulator 30, a wire-cutting mechanism 32, a wire-monitoring component 36, and a spring-forming mechanism 44, in addition to other components. The wire-bending mechanism 26 is configured to bend the wire 24 into a desired shape, such as a sinusoidal wire structure 28, as shown in FIGS. 2 and 4. FIG. 2 also depicts a shuttle 27 for guiding the wire 24 into the wire-bending mechanism 26 during the wire-bending process. The shuttle 27 is more clearly depicted in FIG. 4.

The system 20 further comprises an accumulator 30 for providing a buffer space between the wire-bending mechanism 26 and the wire-cutting mechanism 32. The wire-cutting mechanism 32 may include one or more cutting elements, actuators, servos, and/or advancing/separating components for cutting the sinusoidal wire structure 28 into a plurality of discrete sections 34, which can then be advanced to a wire-monitoring component 36 for feedback generation, and subsequently, to a spring forming mechanism 44. The exemplary wire-monitoring component 36 shown in FIG. 2 includes at least one image-capturing device 38 (e.g., camera), a receiving panel 40, and a backlight 42 for selectively illuminating the receiving-panel 40 during image capture. The image-capturing device 38 is communicatively coupled to one or more computer processors 45 configured to analyze images of the sinusoidal wire structure 28 to generate feedback for the wire-bending mechanism 26. One or more advancing mechanisms (e.g., moving belt(s), wheel(s), sprocket(s), actuator(s), pushing device(s), etc.) may be used throughout the system 20 for moving the sinusoidal wire structure 28, or cut sections thereof, through the various components of the system 20. Additionally, as shown in FIG. 2, the spring-forming mechanism 44 may be used for bending the discrete sections 34 of the sinusoidal wire structure 28 into a desired shape (e.g., a circumferentially shaped spring 35).

In an exemplary operation, the wire-monitoring component 36 receives a discrete section 34 of the sinusoidal wire structure 28 on the receiving panel 40, captures one or more images of the discrete section 34 using the image-capturing device 38 in conjunction with the backlight 42, and analyzes the one or more images using the computer processor(s) 45 to generate feedback for the wire-bending mechanism 26. When one or more characteristics of the sinusoidal wire structure 28 are detected and determined, from the one or more images, to be outside of selected limits (e.g., outside of allowable tolerances or parameters), the computer processor(s) 45 can instruct the wire-bending mechanism 26 and other components of the system 20 to adjust so that the one or more characteristics can be modified. Modification may even be performed in real time, without stopping the wire-bending process, by sending the instruction to the components to initiate an automatic adjustment.

For the wire-monitoring component 36, it should be noted that additional or alternate components may be utilized at the same, different, and/or at multiple locations throughout the system 20. For example, the wire monitoring component 36 may include a plurality of image-capturing devices, receiving panels, and/or backlights positioned at separate locations throughout the system 20 (e.g., at any of first, second, and third locations 15, 17, 19) for monitoring the characteristics of sinusoidal wire structure 28. Distinct analysis by the wire-monitoring component 36 at separate locations may be used to determine if a characteristic of a wire structure formed by the wire-bending mechanism 26 is within preconfigured limits or tolerances, and may be used to generate instructions for the system 20 to modify the same.

In additional embodiments, the computer processor(s) 45, and/or other processors and data storage components associated with the system 20, may be utilized to store and access predetermined configurations of the system 20 that produce specific wire structures and/or spring structures, or rather, "product recipes." In other words, the computer processor(s) 45 may store predetermined configurations of the system 20 (e.g., setup/operation settings of the wire bending mechanism 26, the wire-cutting mechanism 32, and/or or the spring-forming mechanism 44, for example) that can be used to form wire and/or spring structures having specific dimensions, angles, lengths, etc. The predetermined configurations may be applied through manual adjustment of the system 20, and/or may be applied through automatic adjustment of components of the system 20 in response to accessing and initiating the predetermined configurations as an instruction from the computer processor(s) 45. In this respect, the automated and adjustable nature of components of the system 20 may allow different wire structures to be produced with reduced retooling time of the system 20. This may be especially useful when a limited run of products (e.g., springs of a certain size, shape, and configuration) is desired, where adjustment of the components of the system 20 manually would otherwise require a disproportionate amount of setup time compared to the time spent actually producing the limited run of products. The predetermined configurations and product recipes may be stored in internal memory of the computer processor(s) 45, and/or may be stored and provided by other data storage mediums (e.g., mobile storage devices, hard-drives, cloud networks, etc.), including those accessed using a data port (e.g., a USB port), a mobile-computing device (e.g., a smart phone, a smart tablet, etc.), and/or any hardwired and/or wireless communication methods (e.g., Wifi or Bluetooth, etc.). Wired and wireless communication methods are contemplated herein for communication between any of the components of the wire-bending system (e.g., the system 20). It should also be noted that the product recipe function described herein may be used in addition to real-time feedback and adjustment of the wire-bending system, as discussed in other sections of this disclosure.

The spring-forming mechanism 44 shown in FIG. 2 bends the discrete sections 34 of the sinusoidal wire structure 28 into circumferentially shaped springs 35, which may then be used in various applications, such as seating (e.g., couches, chairs, beds, etc.). In FIG. 2, a spring-monitoring component 48 is also provided along with the spring-forming mechanism 44 for monitoring and generating feedback on the circumferentially shaped springs 35 in a similar fashion as performed by the wire-monitoring component 36. For example, the spring-monitoring component 48 may include one or more image-capturing devices 50 located over a spring-conveyer 52 for capturing images of the circumferentially shaped springs 35 that are formed by the spring-forming mechanism 44. Similar features, such as backlighting and computer processors communicatively coupled to the image-capturing device(s) 50, may be used with the spring-monitoring component 48 to monitor one or more characteristics of the circumferentially shaped springs 35. As such, when one or more monitored characteristics of the circumferentially shaped springs 35 are outside of selected limits (e.g., a radius, diameter, circumferential shape, size, etc.), the spring-monitoring component 48 may instruct the spring-forming mechanism 44 to make an adjustment to modify the characteristic (or simply provide a notification that a modification is needed). This monitoring, instruction, and adjustment may occur during continuous operation of the spring-forming mechanism 44, in certain embodiments.

Referring to FIGS. 3A-3C, a wire, a wire bent into a sinusoidal wire structure, and a spring formed from the sinusoidal wire structure are provided, respectively, in accordance with embodiments of the present technology. FIG. 3A depicts the wire 24 in a preformed state, or rather, a state prior to bending by a wire-bending mechanism, such as the wire-bending mechanism 26 shown in FIG. 2. FIG. 3B depicts the wire 24 bent into the sinusoidal wire structure 28 shown in FIG. 2, which includes a plurality of repeating sinusoidal curves 54. The sinusoidal wire structure 28 further includes safety ends 33, which may be formed from bending the ends of the sinusoidal wire structure 28 after cutting. The safety ends 33 may be provided to prevent a clip attached to the ends of the sinusoidal wire structure 28 from sliding off during use. FIG. 3C depicts the sinusoidal wire structure 28 of FIG. 3B formed into the circumferentially shaped spring 35 shown in FIG. 2. Once again, different wires, sinusoidal wire structures, and springs, including those of different sizes, dimensions, and/or angular orientations, are possible and contemplated herein. For example, a spring formed from the sinusoidal wire structure 28 may have a flat configuration, in which case, a different spring forming, monitoring, and/or stacking mechanism may be used.

Referring to FIG. 4, an enhanced view of the wire-bending mechanism 26 depicted in FIG. 2 is provided, in accordance with an embodiment of the present technology. The wire-bending mechanism 26 includes a housing 55, a wire-bending element 56 including a pair of forming pins 64, a retainer tool 58, an adjusting element 57 coupled to the wire-bending element 56 through the housing 55, and a post-forming tensioning device 60. The movement of the wire-bending element 56 is driven by a rotational actuator located beneath the surface on which the wire 24 is bent. In this respect, the rotational actuator provides the oscillation of the wire-bending element 56. The adjusting element 57 is coupled to a cam assembly that allows the rotary motion of the wire-bending element 56 to be adjusted to a vertical motion, to allow raising and lowering of the wire-bending element 56 and the pair of forming pins 64. The interaction of the wire-bending element 56 and the retainer tool 58 are shown in greater detail in FIGS. 5 and 6A-6B.

The post-forming tensioning device 60 may or may not be used with, or during, operation of the system 20, and is located on the input side of the accumulator 30 (shown in FIG. 2). When in use, the post-forming tensioning device 60 may advance the sinusoidal wire structure 28 after it exits the wire-bending mechanism 26. The post-forming tensioning device 60 includes a servo actuator 59 and a sprocket wheel 53. The servo actuator 59 rotates the sprocket wheel 53 to control the position and advancement of the sinusoidal wire structure 28 towards the accumulator 30 (e.g., driving it forward and pausing it). The post-forming tensioning device 60 may be timed to the oscillation of the wire-bending element 56. The post-forming tensioning device 60 and the servo actuator 59 thereof may also be controlled by the one or more computer processor(s) 45. When in use, stretching and/or compressing of the sinusoidal wire structure 28 may be provided through interaction of the wire-bending element 56 and the post-forming tensioning device 60.

In advance of the wire-bending mechanism 26 shown in FIG. 4 is the wire pre-tensioning device 25, which includes a plurality of rollers 31 through which the wire 24 travels prior to entering the wire-bending mechanism 26. The wire pre-tensioning device 25 can apply tension to the wire 24 as it travels to the wire-bending mechanism 26, in order to straighten the wire 24. The wire pre-tensioning device 25 may be manually adjustable, and/or may be adjustable automatically, such as using a servo in communication with the one or more computer processor(s) 45 associated with the system 20. The servo may receive instructions from the one or more computer processor(s) 45 to automatically adjust the operation of the pre-tensioning device 25. It should be noted that any of the components discussed herein that affect the wire bending process, including the wire pre-tensioning device 25, the wire-bending mechanism 26, the wire-bending element 56, the retainer tool 58, the shuttle 27, the post-forming tensioning device 60, and the servo actuator 59, among other components of the system 20, may be in communication with, and/or controlled by, the one or more computer processors 45 that can instruct the components for automatic adjustment thereof.

In an exemplary operation of the system 20, the wire 24 is guided into the wire pre-tensioning device 25 where the rollers 31 straighten the wire 24. The wire 24 then passes through the shuttle 27 which moves back and forth to align the wire 24 to either side in conjunction with the back and forth oscillation of the wire-bending element 56 (the shuttle 27 is shown in greater detail in FIG. 5). The wire 24 then enters the wire-bending mechanism 26, where it is bent by the wire-bending element 56 and the retainer tool 58, which act together to continuously bend the wire 24 to form the sinusoidal wire structure 28 (the wire-bending process is shown in greater detail in FIGS. 6A-6B).

Figure 5:
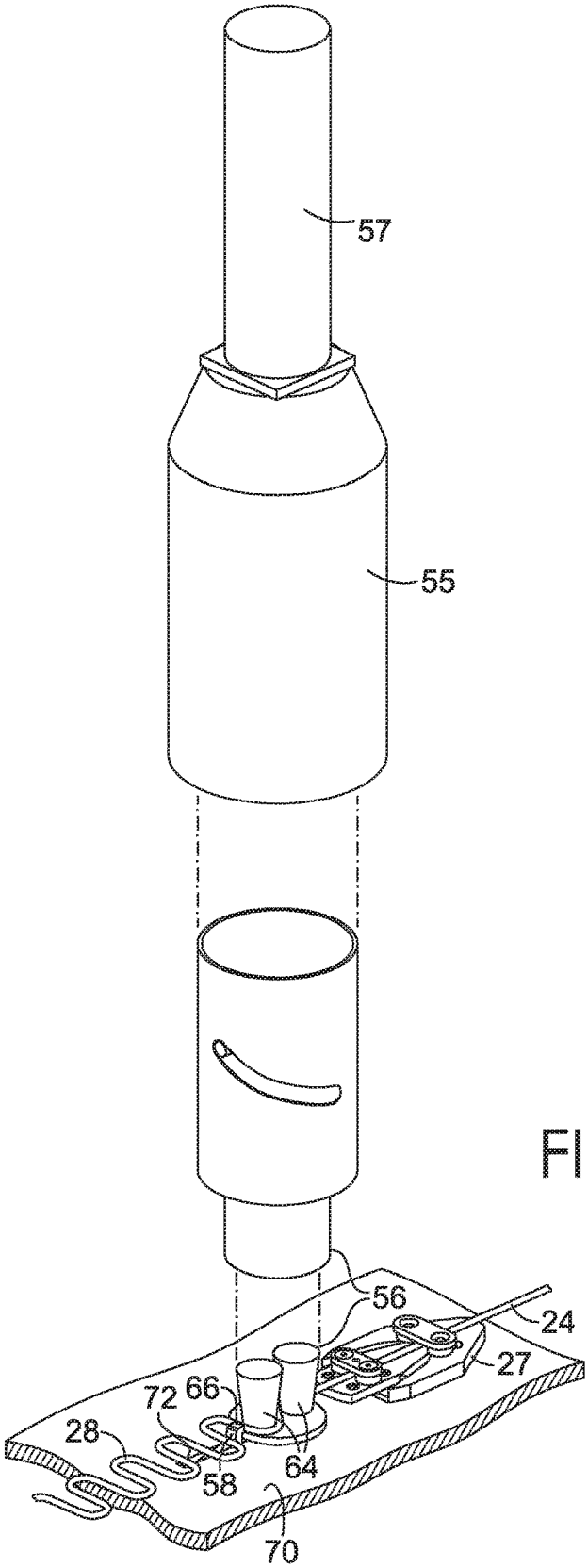
FIG. 5 is an exploded view of the wire-bending mechanism depicted in FIG. 4, in accordance with an embodiment of the present technology.

Referring to FIG. 5, an exploded view of the wire-bending mechanism 26 shown in FIG. 4 is provided, in accordance with an embodiment of the present technology. In FIG. 5, the wire-bending element 56 and the retainer tool 58 are shown adjacent to the shuttle 27. The wire-bending element 56 further includes a pair of forming pins 64 each having a tapered profile. A rotational actuator is located below a surface 70 on which the wire 24 is received. The rotational actuator (obscured by the surface 70) is coupled to the wire-bending element 56 through the surface 70, so that it can apply rotational force to the wire-bending element 56 to provide a back and forth oscillating motion of the pair of forming pins 64 for bending the wire 24. The speed of oscillation of the pair of forming pins 64 may vary, but in an exemplary operation, the speed may be ten oscillations per second. The retainer tool 58 may also be driven back and forth by the movement of the rotational actuator.

The tapered configuration of the pair of forming pins 64 allows for adjustment of the characteristics of the sinusoidal wire structure 28 based on the vertical position of the pair of forming pins 64 relative to the wire 24. In other words, a circumference of each of the pair of forming pins 64 that makes contact with the wire 24 may be changed by raising or lowering the pair of forming pins 64 relative to the wire 24, which may subsequently affect a characteristic of the sinusoidal wire structure 28 (e.g., radius, curvature, etc.). The tapered profile of the pair of forming pins 64 may therefore provide unlimited adjustment of the characteristics of the sinusoidal wire structure 28, and may further provide a downward force on the wire 24 that helps maintain the wire 24 in position against the surface 70. Adjustment of the vertical position of the pair of forming pins 64 may occur based on feedback received from the wire-monitoring component 36, through instructions from the one or more computer processors 45 based on certain desired product recipes, and through subsequent adjustment of the adjusting element 57.

FIG. 5 further depicts the retainer tool 58 proximate the wire-bending element 56. The retainer tool 58 is configured to selectively provide a counterforce against the force of the wire-bending element 56 and forming pins 64 thereof during bending of the wire 24. The retainer tool 58 includes a hook portion 66 for engaging the wire 24, and is configured to move between a first position for bracing the wire 24 and a second position that does not brace the wire 24 and that allows the wire 24 to advance without obstruction from the retainer tool 58. The retainer tool 58 is positioned at least partially beneath the surface 70, and is movable between the first position and the second position through an aperture 72 in the surface 70. Operation of the retainer tool 58 is depicted in greater detail in FIGS. 6A-6B.

Further depicted in FIG. 5 is the shuttle 27. The shuttle 27 is located adjacent the wire pre-tensioning device 25, and may be used to affect the straightness of the wire 24 in a side-to-side direction as the wire 24 enters the wire-bending mechanism 26, where the oscillation of the wire-bending element 56 moves the wire 24 back and forth to bend it into the sinusoidal wire structure 28. The shuttle 27 may be coupled to a servo that can adjust the position of the shuttle 27, such as through instruction from the one or more computer processors 45. Adjustments to the shuttle 27, and subsequently the wire 24, may occur without stopping movement of the wire 24 through the system 20 (i.e., during production of a desired wire structure). In operation, the shuttle 27 oscillates back-and-forth a set number of degrees per unit of time in conjunction with the movement of the wire-bending element 56. In this respect, the shuttle 27 prepares the wire for bending by the wire-bending element 56, and may move in coordination with the wire-bending element 56. Additionally, the position of the shuttle 27 may be adjusted manually, or automatically using a servo in communication with the one or more computer processors 45.

The shuttle 27 may be driven by a gearbox and/or actuator that are common to the wire-bending mechanism 26, or rather, that also drive the movement of the components of the wire-bending mechanism 26. The degree of oscillation of the shuttle 27 may not change, but the amount of offset (i.e., position) of the shuttle 27 relative to the wire 24 (i.e., to one side or the other of the incoming wire 24) may be adjusted using a servo, with the repeated movement of the shuttle 27 being provided by the gearbox and/or actuator common to the wire-bending mechanism 26. The motion of the shuttle 27 may therefore be driven by the actuator, and the offset adjustment may be controlled by the servo.

Figure 6A:
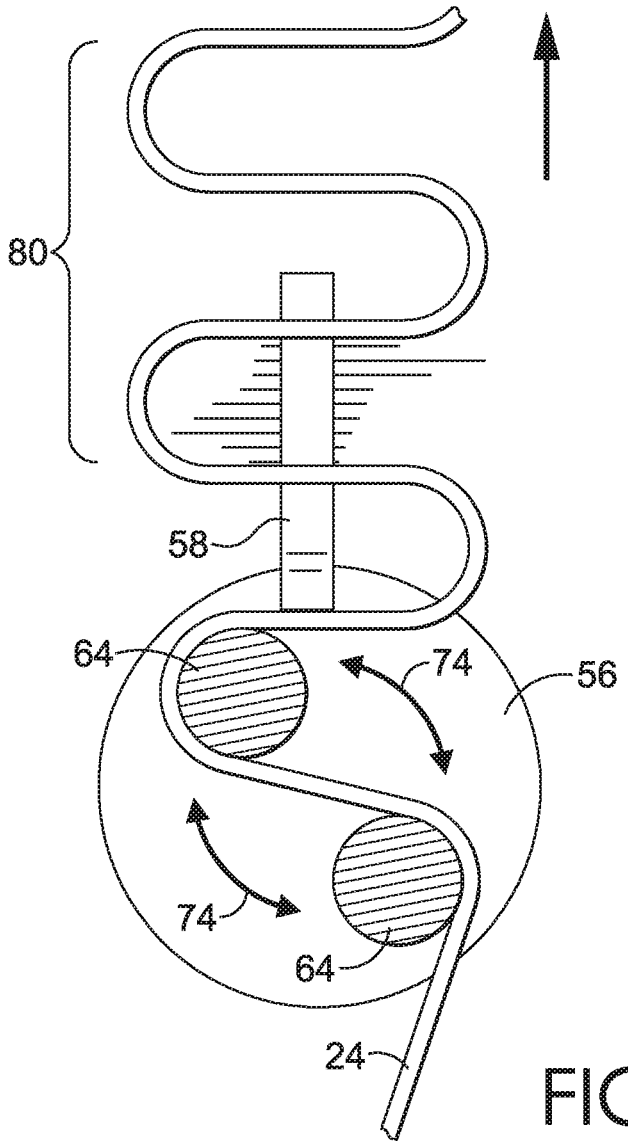
FIGS. 6A-6B depict an exemplary operation of the wire-bending mechanism depicted in FIGS. 4-5 from alternate cross-sectional perspectives, in accordance with embodiments of the present technology.
Figure 6B:
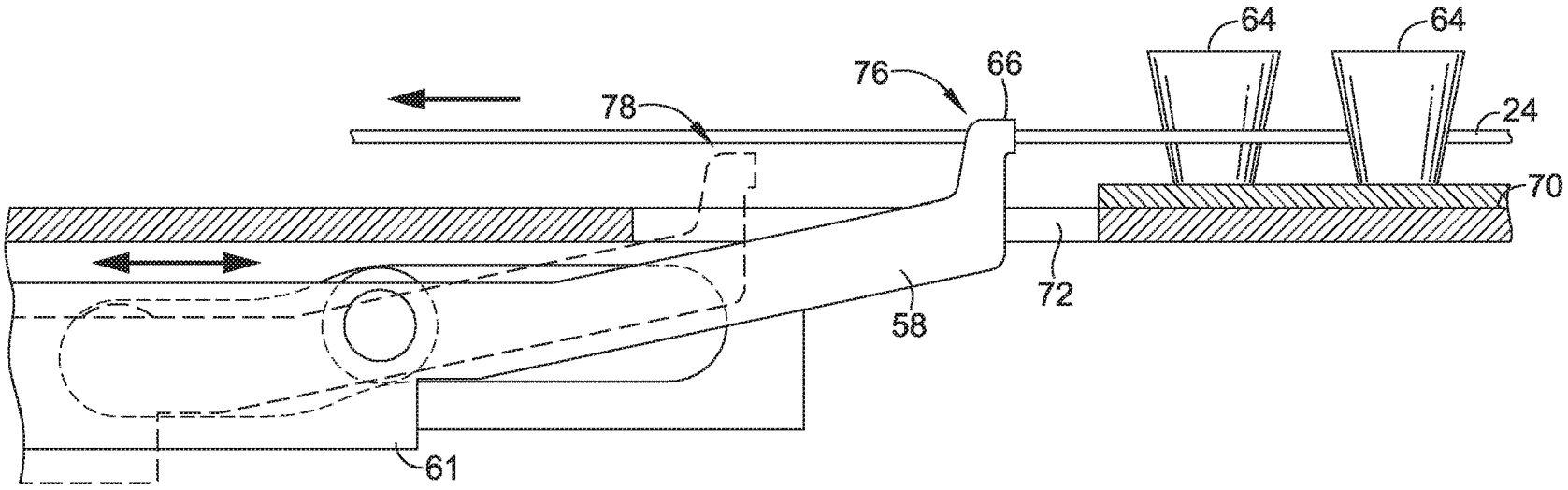

Referring to FIGS. 6A-6B, an exemplary wire-bending process performed by the wire-bending mechanism 26 shown in FIG. 4 is provided, in accordance with an embodiment of the present technology. FIG. 6A depicts a top-down, cross-sectional view of the interaction between the wire 24, the wire-bending element 56, and the retainer tool 58. During the wire-bending process, the wire 24 advances incrementally between the pair of forming pins 64, which oscillate back and forth in a selected range of motion. The retainer tool 58 is moved to a first position 76, shown in FIG. 6B, which braces the wire 24. The oscillation of the pair of forming pins 64 applies a two-point bending force 74 to the wire 24, which bends the wire 24 against the counterforce applied by the retainer tool 58, which is bracing the wire 24 in the first position 76. Once the wire 24 is bent, and the pair of forming pins 64 are prepared to reverse direction, the retainer tool 58 moves to the second position 78, shown in FIG. 6B, removing the counterforce against the wire 24 and allowing the wire 24 to advance to the next position without obstruction from the retainer tool 58. As a result, the wire 24 is bent repeatedly to form a sinusoidal pattern 80 using oscillation of the wire-bending element 56 and movement of the retainer tool 58 between the first position 76 and the second position 78. FIG. 6B depicts a side elevation, cross-sectional view of the pair of forming pins 64 and the retainer tool 58, showing the movement of the retainer tool 58 between the first position 76 and the second position 78 during the wire-bending process. The retainer tool 58 moves back and forth on a track 61, as shown in FIG. 6B.

Figure 7:
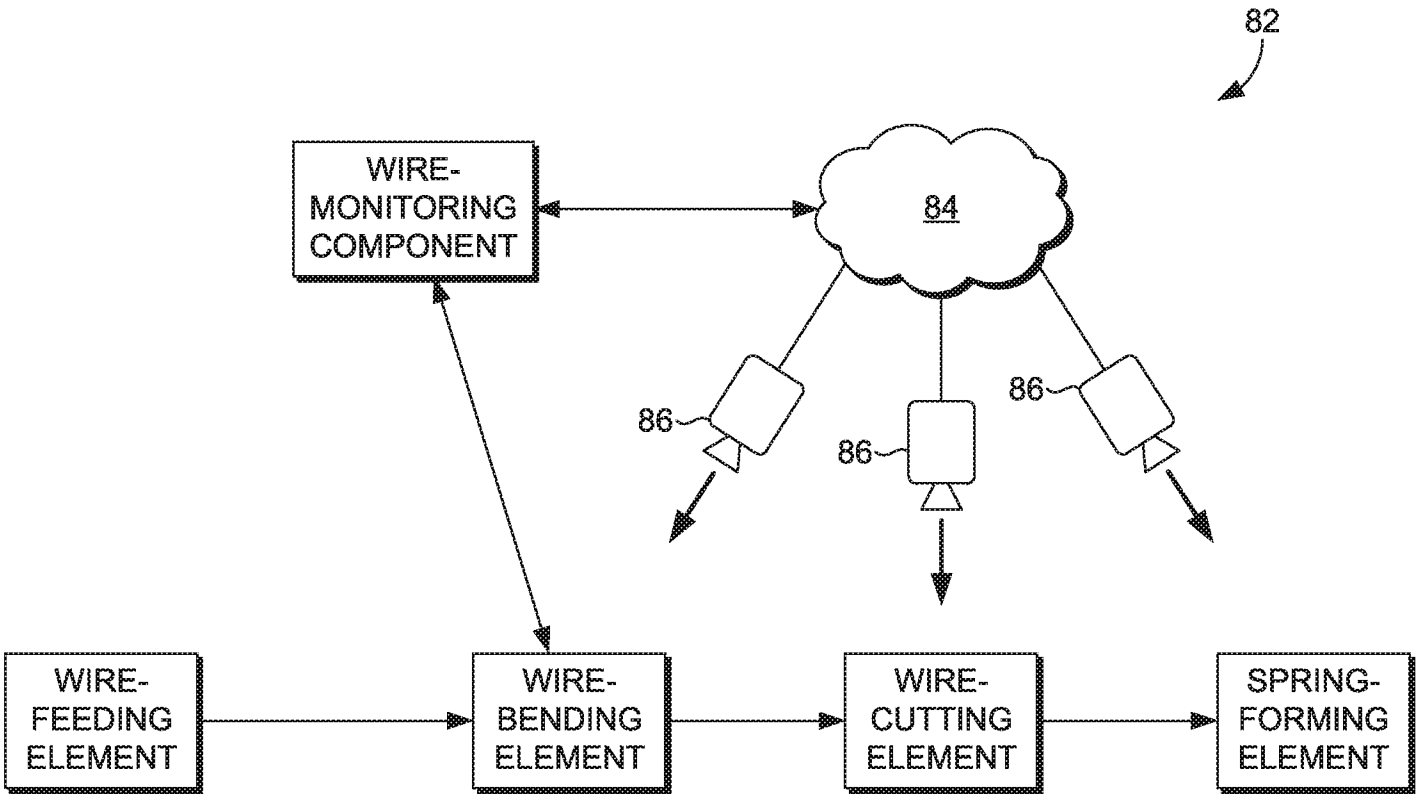
FIG. 7 depicts an exemplary system for feedback-based wire bending, in accordance with an embodiment of the present technology.

Referring to FIG. 7, an exemplary system 82 for feedback-based wire bending is provided, in accordance with an embodiment of the present technology. The system 82 depicted in FIG. 7 includes a wire-feeding element, such as the wire-feeding element 22 depicted in FIG. 2, a wire-bending element, such as the wire-bending mechanism 26 depicted in FIGS. 2, 4, and 5, a wire-cutting element, such as the wire-cutting mechanism 32 depicted in FIG. 2, and a spring-forming element, such as the spring-forming mechanism 44 depicted in FIG. 2. These elements may be used to sequentially feed, bend, and cut a wire for formation into a spring structure, such as the circumferentially shaped springs 35 depicted in FIGS. 2 and 3C. Further depicted in FIG. 7 is a wire-monitoring component, such as the wire-monitoring component 36 depicted in FIG. 2, which is communicatively coupled to a network 84 that provides communication with a plurality of image-capturing devices 86 (e.g., cameras). It should be noted that three image-Page capturing devices 86 are provided in FIG. 7, but more or fewer, in the same or separate locations, are possible and contemplated. The image-capturing devices 86 are configured to capture one or more images of a wire and communicate the one or more images back to the wire-monitoring component, which may further include one or more computer processors for analyzing the characteristics of the wire detected from the one or more images, and for generating an instruction for the wire-bending element if it is determined that one or more characteristics of the wire are outside of selected limits. The wire-monitoring component, including the one or more computer processors thereof, may communicate wirelessly or over hardwired communication methods to the wire-bending element, in various embodiments.

Figure 8A:
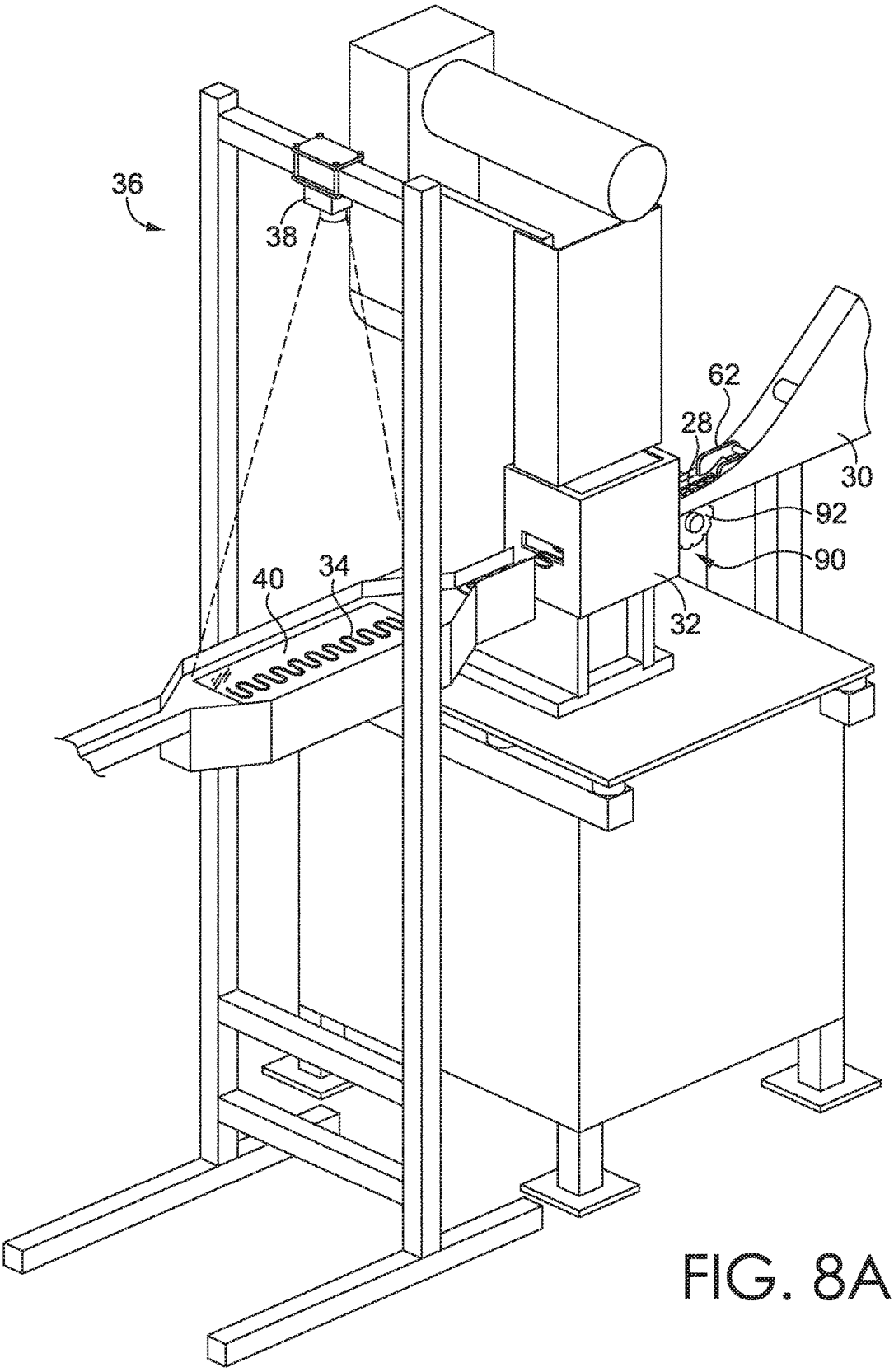
FIG. 8A depicts an enhanced view of a wire-cutting mechanism and elements of a wire-monitoring component as shown in FIG. 2, in accordance with an embodiment of the present technology.

Referring to FIG. 8A, an enhanced view of the wire-cutting mechanism 32 and the wire-monitoring component 36 of FIG. 2 are provided, in accordance with an embodiment of the present technology. As shown in FIG. 8A, the sinusoidal wire structure 28 is fed into the wire-cutting mechanism 32 from the accumulator 30, where it is cut into a plurality of discrete sections 34. As shown in FIG. 8A and also in FIG. 8B, between the accumulator 30 and the wire-cutting mechanism 32 is a press-feed device 90 including a feed wheel 92. The press-feed device 90 may be servo-driven, and through sequential rotation of the feed wheel 92, the press-feed device 90 may count the number of bars of the sinusoidal wire structure 28 passing thereover to the cutting operation at the wire-cutting mechanism 32. The press-feed device 90 may therefore control the timing of the wire-feed cycle, providing wire to the wire-cutting mechanism 32 as desired.

Each discrete section 34 is advanced from the wire-cutting mechanism 32 onto the receiving panel 40, where it may or may not be backlit for image capture by the image-capturing device 38. The image-capturing device 38 captures one or more images of the discrete section 34 and communicates the captured images to the one or more computer processors 45 associated with the wire-monitoring component 36 for analysis. The analyzed discrete section 34 may then be advanced again, and another discrete section 34 of the sinusoidal wire structure 28 may be moved onto the receiving panel 40, and the process repeated.

Figure 8B:
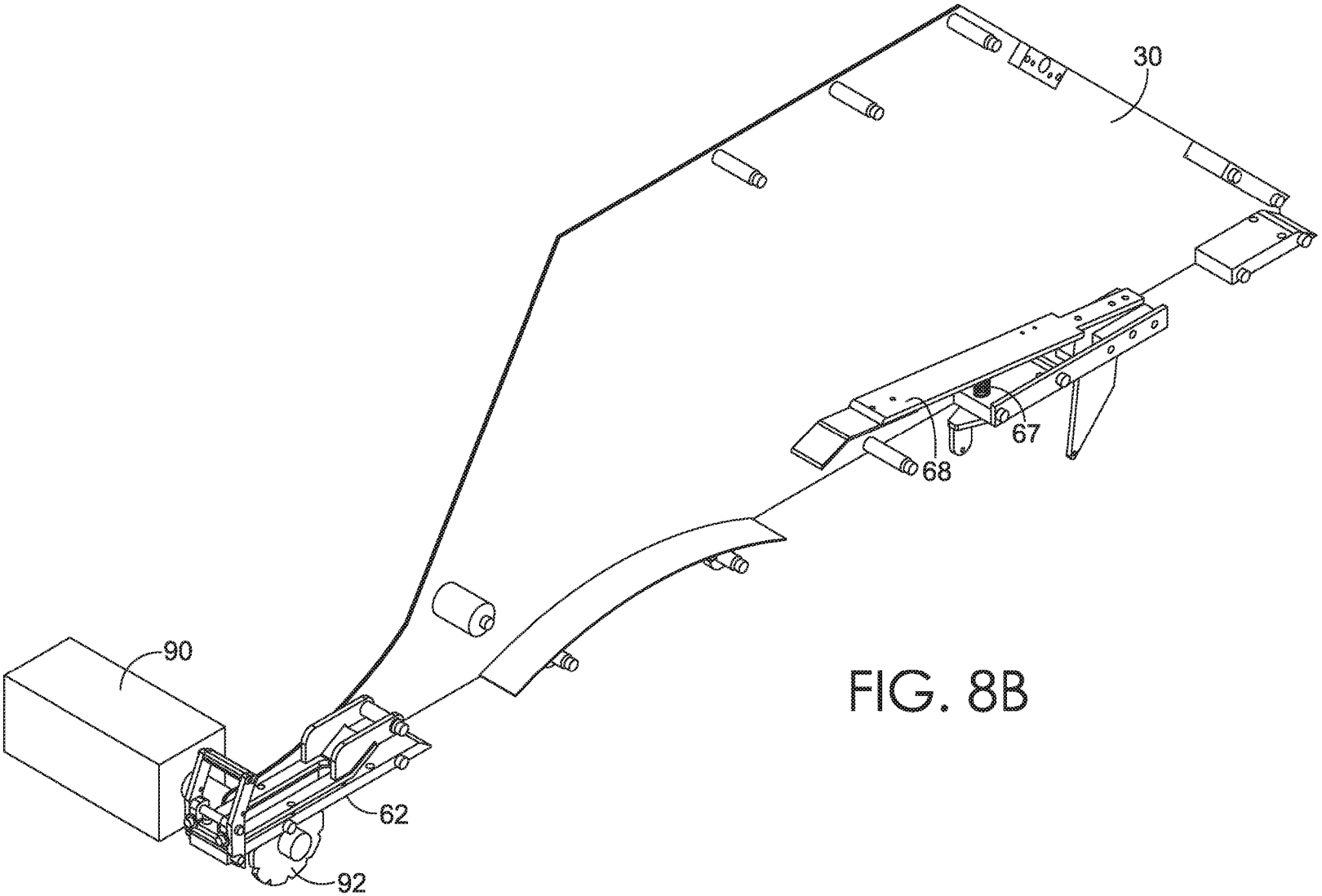
FIG. 8B depicts an angled, interior, perspective view of an accumulator used with the system depicted in FIG. 2, in accordance with an embodiment of the present technology.

Referring to FIG. 8B, an angled, perspective, interior view of the accumulator 30 depicted in FIG. 2 is shown, in accordance with an embodiment of the present technology. The accumulator 30 may allow the sinusoidal wire structure 28 produced by the wire-bending mechanism 26 to accumulate while a section of the sinusoidal wire structure 28 is cut and advanced within the wire-cutting mechanism 32. In this regard, the accumulator 30 allows accumulation of the sinusoidal wire structure 28 without stopping the wire bending by the wire-bending element 56, or the cutting by the wire-cutting mechanism 32.

The exemplary accumulator 30 shown in FIG. 8B depicts the positioning of the press-feed device 90 and the feed wheel 92. In operation, the sinusoidal wire structure 28 travels through the accumulator 30 from right to left relative to FIG. 8B, being fed initially from the post-forming tensioning device 60 (not depicted but shown in FIG. 4B) into the accumulator 30. The interior of the accumulator 30 includes a dancer arm 68 that is elastically supported by a spring element 67. The dancer arm 68 may be used to detect a level of wire inside the accumulator 30, and may be communicatively connected to an encoder which determines if the level of wire is within an acceptable range. The encoder may be part of, and/or communicatively connected to, the one or more computer processors 45, and may be used to provide feedback to allow the system 20 to slow or speed up the pace of the wire entering the accumulator 30, and/or to slow or speed up the press-feed device 90 to control the pace of the wire going out of the accumulator 30. Such adjustments may be made automatically or through manual input. Further depicted in FIG. 8B is a hold-down device 62 that holds the wire in the press-feed device 90 for interaction with the feed wheel 92.

Figure 8C:
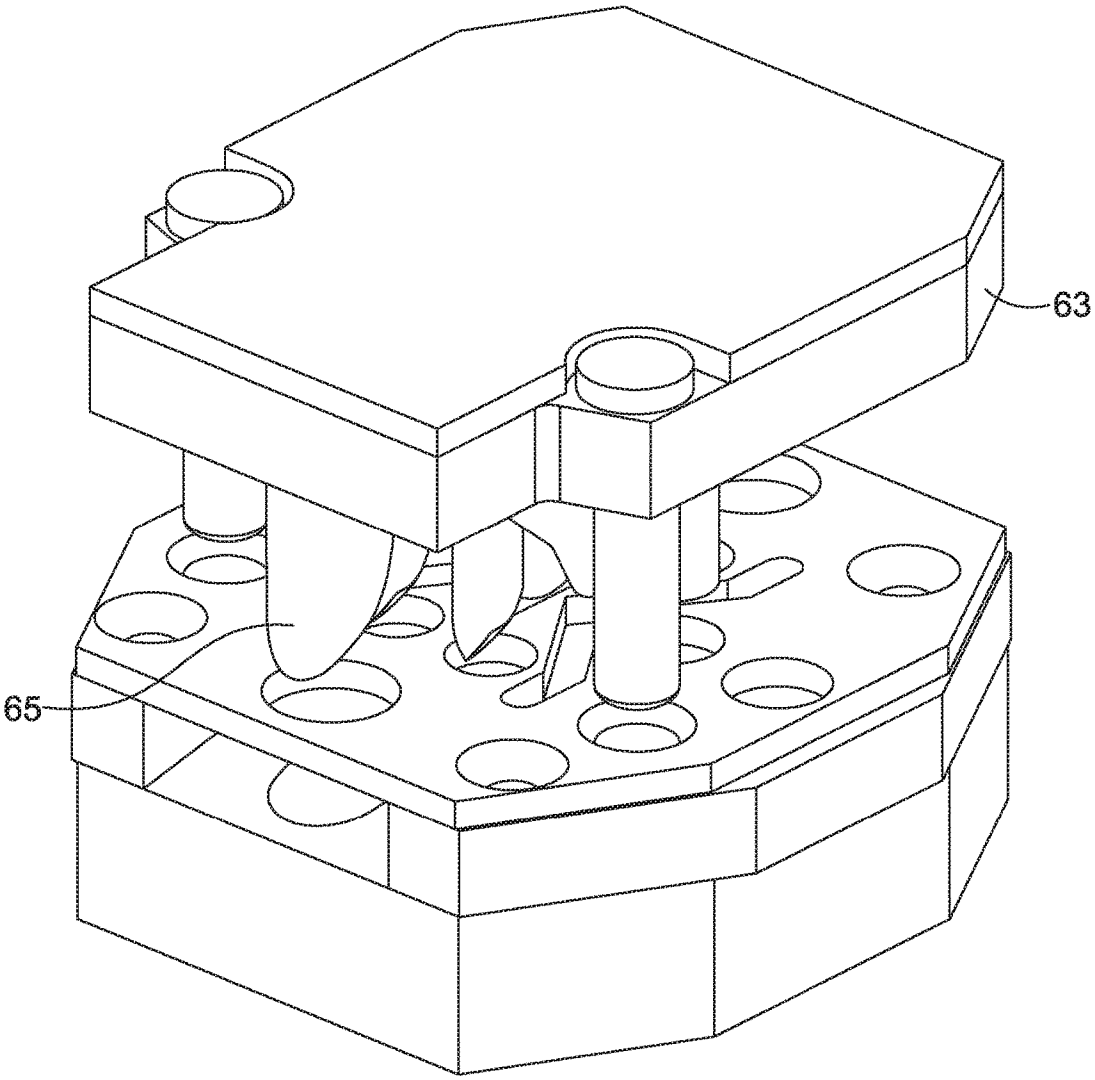
FIG. 8C depicts an angled, perspective view of components of a wire-cutting mechanism used with the system depicted in FIG. 2, in accordance with an embodiment of the present technology.

Referring to FIG. 8C, an enhanced, partial, interior view of the wire-cutting mechanism 32 used with the system 20 depicted in FIG. 2 is provided, in accordance with an embodiment of the present technology. The exemplary wire-cutting mechanism 32 depicted in FIG. 8C includes a servo-controlled punch press 63 with a die 65 that may be used to locate and cut the sinusoidal wire structure 28 into the discrete sections 34. The die 65 may separately and/or simultaneously form the safety ends 33 into the ends of the discrete sections 34, as shown in FIG. 3B. The discrete sections 34 can then be advanced, such as with an advancing mechanism (rotating sprocket, moving element, etc.), and the process repeated.

Figure 8D:
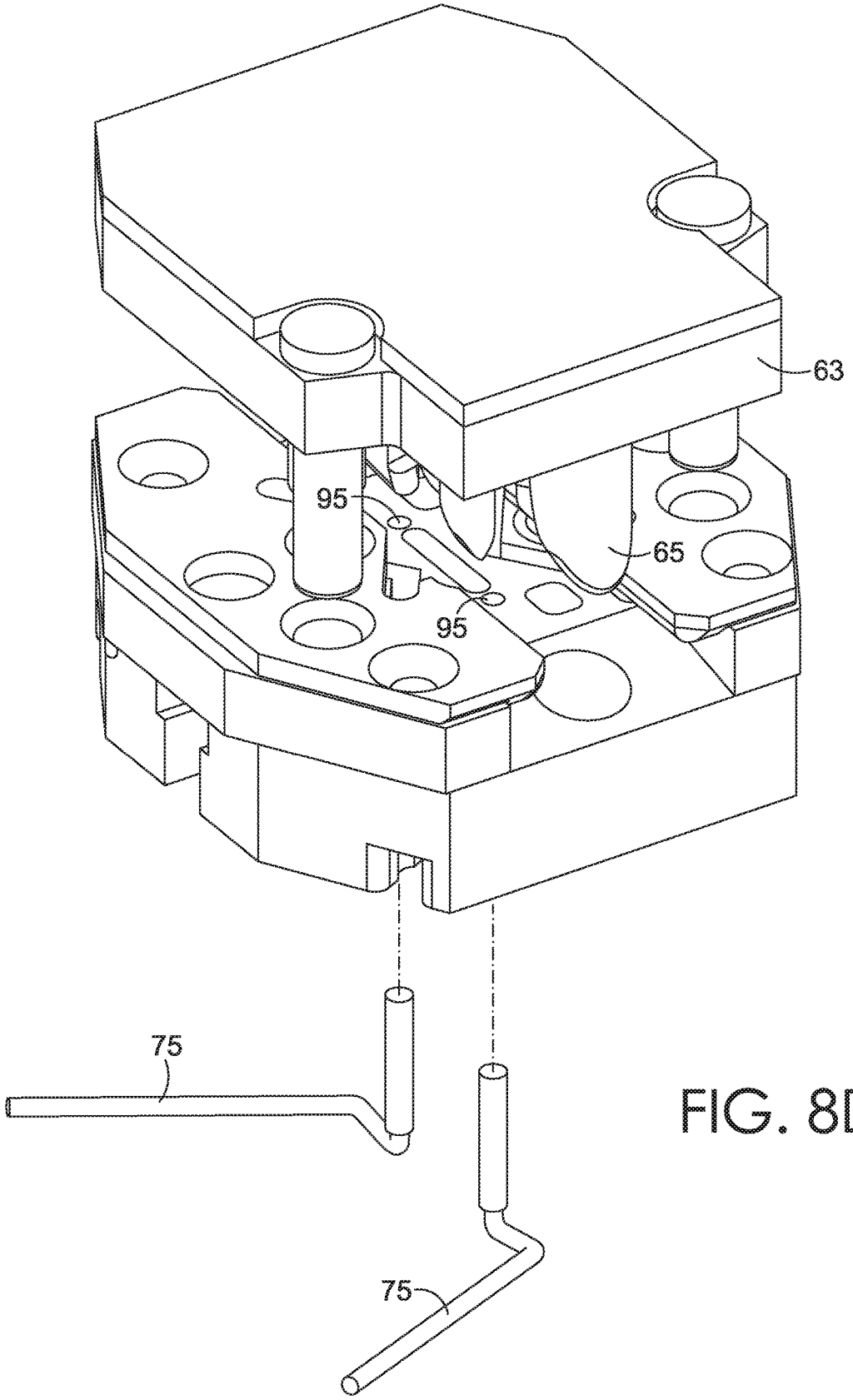
FIG. 8D depicts an exploded view of the wire-cutting mechanism of FIG. 8C, in accordance with an embodiment of the present technology.

Referring to FIG. 8D, an exploded view of the wire-cutting mechanism 32 of FIG. 8C is provided, in accordance with an embodiment of the present technology. As shown in FIG. 8D, the punch press 63 and/or the die 65 may include one or more proximity sensors 75 that may continuously or selectively detect a position of the sinusoidal wire structure 28 within the wire-cutting mechanism 32, allowing a desired position, length, and/or alignment of the sinusoidal wire structure 28 to be achieved during the cutting process. This may help to provide consistent cutting and sizing of the wire. The proximity sensors 75 may extend through holes 95 towards the die 65, where they can detect a position of a wire in the punch press 63. The proximity sensors 75 may be further configured for activation and deactivation during the wire-cutting process, in case they are damaged or otherwise need to be activated/deactivated.

In an exemplary wire-cutting operation, a predetermined length of the sinusoidal wire structure 28 may be fed at a controlled rate into the wire-cutting mechanism 32 (e.g., which in different embodiments may include at least one die, punch press, shearing or cutting elements, etc.). The movement of the sinusoidal wire structure 28 may be stopped while the sinusoidal wire structure 28 is cut by the wire-cutting mechanism 32. At the same time, the accumulator 30 may store the length of the sinusoidal wire structure 28 that is generated from the wire-bending mechanism 26, so that the wire-bending mechanism can continue operation. Once cutting of the sinusoidal wire structure 28 is completed by the wire-cutting mechanism 32, the discrete section 34 that has been cut may be advanced out of the wire-cutting mechanism 32, and the accumulated portion of the sinusoidal wire structure 28 may be fed into the wire-cutting mechanism 32 to continue the process. The programming of the feed cycle as described above may be controlled so that there is always enough length of the sinusoidal wire structure 28 to be fed, but not so much that the accumulator 30 becomes overfilled. This can be adjusted as needed within the system 20.

Figure 9A:
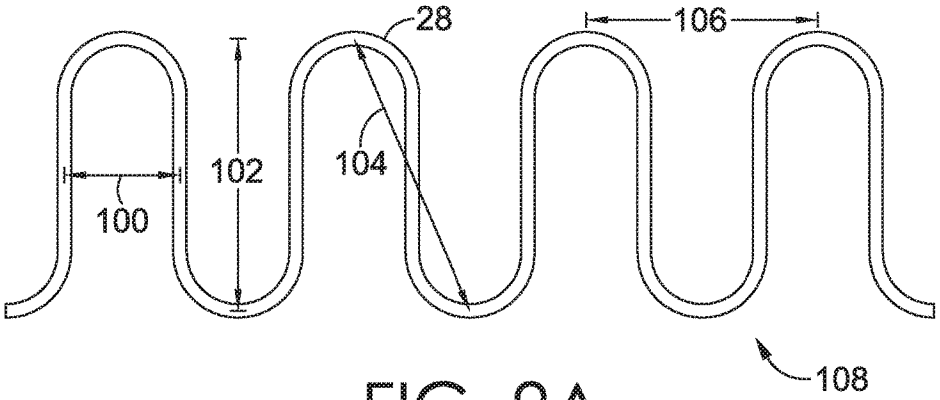
FIGS. 9A-9B depict exemplary characteristics of a sinusoidal wire structure that may be detected and analyzed by a wire-monitoring component, in accordance with embodiments of the present technology.
Figure 9B:
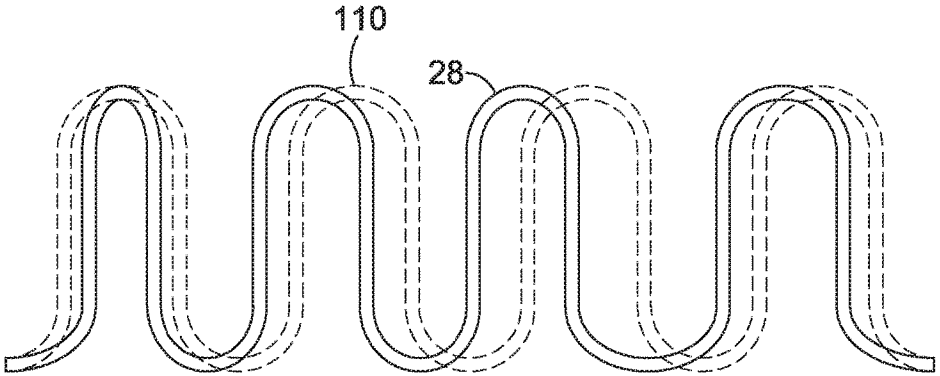

Referring to FIGS. 9A-9B, exemplary characteristics of a sinusoidal wire structure 28 that may be detected by a wire-monitoring component are provided, in accordance with an embodiment of the present technology. In FIGS. 9A-9B, a sinusoidal wire structure 28 is shown that includes a plurality of sinusoidal curves. Additionally, identified on the sinusoidal curves are a plurality of characteristics 100, 102, 104, 106, 108, which may be detected by a wire-monitoring component, such as the wire-monitoring component 36 shown in FIG. 2, to generate feedback and/or instructions for a wire-bending mechanism, such as the wire-bending mechanism 26 shown in FIG. 2, to allow for modification of one or more of the characteristics 100, 102, 104, 106, 108 of the sinusoidal wire structure 28 when one or more of the characteristics 100, 102, 104, 106, 108 are determined to be outside of selected limits, ranges, and/or minimums/maximums.

In FIG. 9A, the characteristics 100, 102, 104, 106, 108 include a first characteristic 100 comprising a distance between points on a common sinusoidal curve, a second characteristic 102 comprising a height of repeating sinusoidal curves, third and fourth characteristics 104, 106 comprising a distance between points on adjacent sinusoidal curves, and/or an overall shape 108 of the sinusoidal wire structure 28. Additionally, as shown in FIG. 9B, a shape of the sinusoidal wire structure 28 may be extracted from one or more images of the same and compared to an outline 110 of a desired sinusoidal curve, from which appropriate modifications may be determined for a wire-bending mechanism to achieve the same. It should be noted that the characteristics discussed with respect to FIGS. 9A-9B are merely exemplary, and other detectable characteristics may be used and determined from images captured and analyzed by a wire-monitoring component as well.

Figure 10:
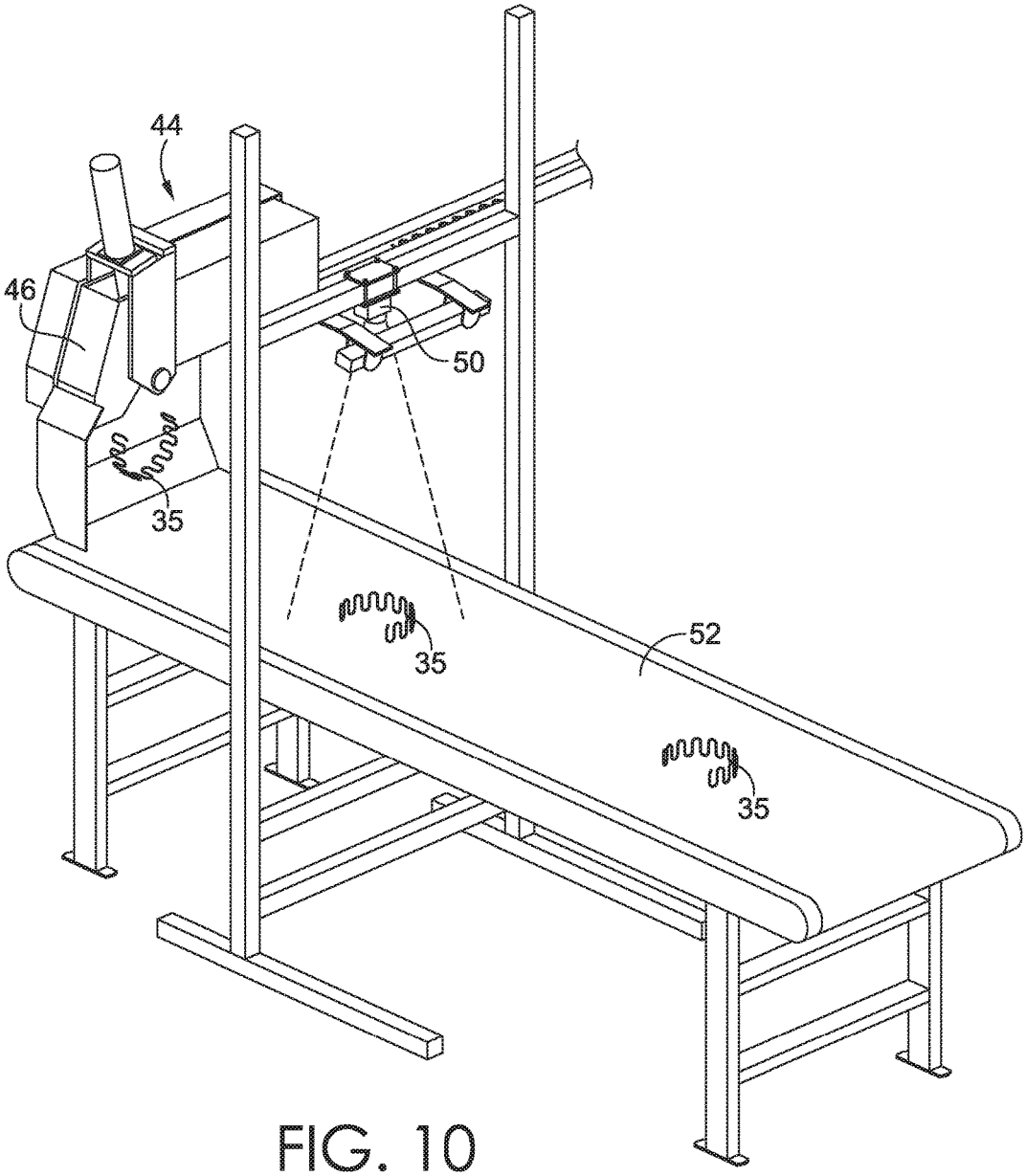
FIG. 10 depicts an enhanced view of a spring-forming mechanism used with the system depicted in FIG. 2, in accordance with an embodiment of the present technology.

Referring to FIG. 10, an enhanced view of the spring-forming mechanism 44 shown in FIG. 2 is provided, in accordance with an embodiment of the present technology. FIG. 10 further shows how the circumferentially shaped springs 35 are produced by the spring-forming mechanism 44 using an actuator 46, which bends and transfers the circumferentially shaped springs 35 to a spring-conveyer 52. The one or more image-capturing devices 50 of the spring-monitoring component 48 capture images of the circumferentially shaped springs 35 and communicate them to a computer processor associated with the spring-monitoring component 48. The computer processor identifies one or more characteristics of the circumferentially shaped springs 35, as discussed above, and provides feedback/instruction to the spring-forming mechanism 44 to adjust the desired characteristics of the circumferentially shaped springs 35.

Figure 11:
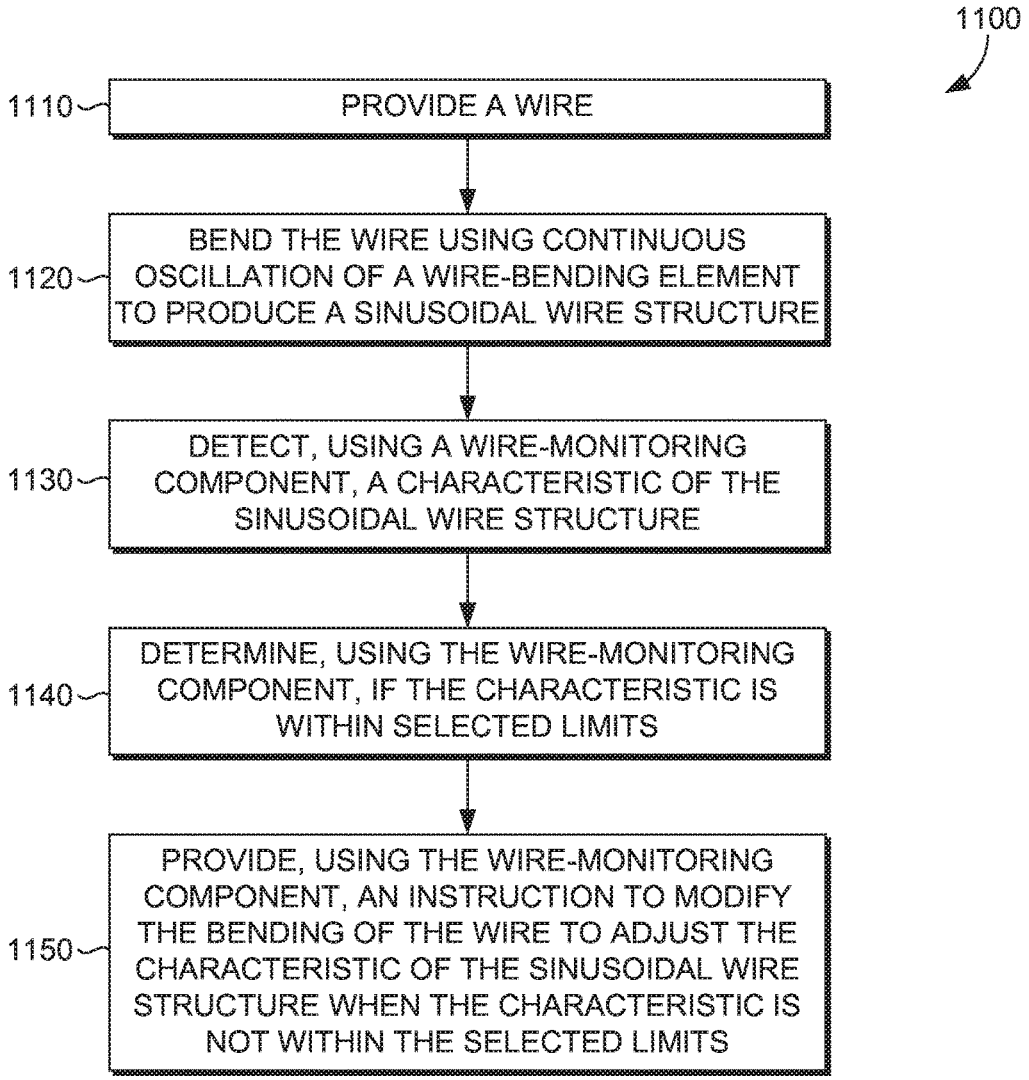
FIG. 11 depicts a block diagram of a first exemplary method of feedback-based wire bending, in accordance with an embodiment of the present technology.

Referring to FIG. 11, a block diagram of an exemplary method 1100 of feedback-based wire bending is provided, in accordance with an embodiment of the present technology. At a block 1110, a wire, such as the wire 24 shown in FIG. 2, is provided. At a block 1120, the wire is bent using continuous oscillation of a wire-bending element, such as the wire-bending element 56 shown in FIG. 5, to produce a sinusoidal wire structure, such as the sinusoidal wire structure 28 shown in FIG. 2. At a block 1130, a characteristic of the sinusoidal wire structure is detected using a wire-monitoring component, such as the wire-monitoring component 36 shown in FIG. 2. At a block 1140, it is determined, by the wire-monitoring component, if the characteristic is within selected limits, such as a range of tolerances, a maximum allowable deviation, and/or a selected dimensional range, for example. At a block 1150, an instruction is provided by the wire-monitoring component to modify the bending of the wire to adjust the characteristic of the sinusoidal wire structure when the characteristic is not within the selected limits.

Figure 12:
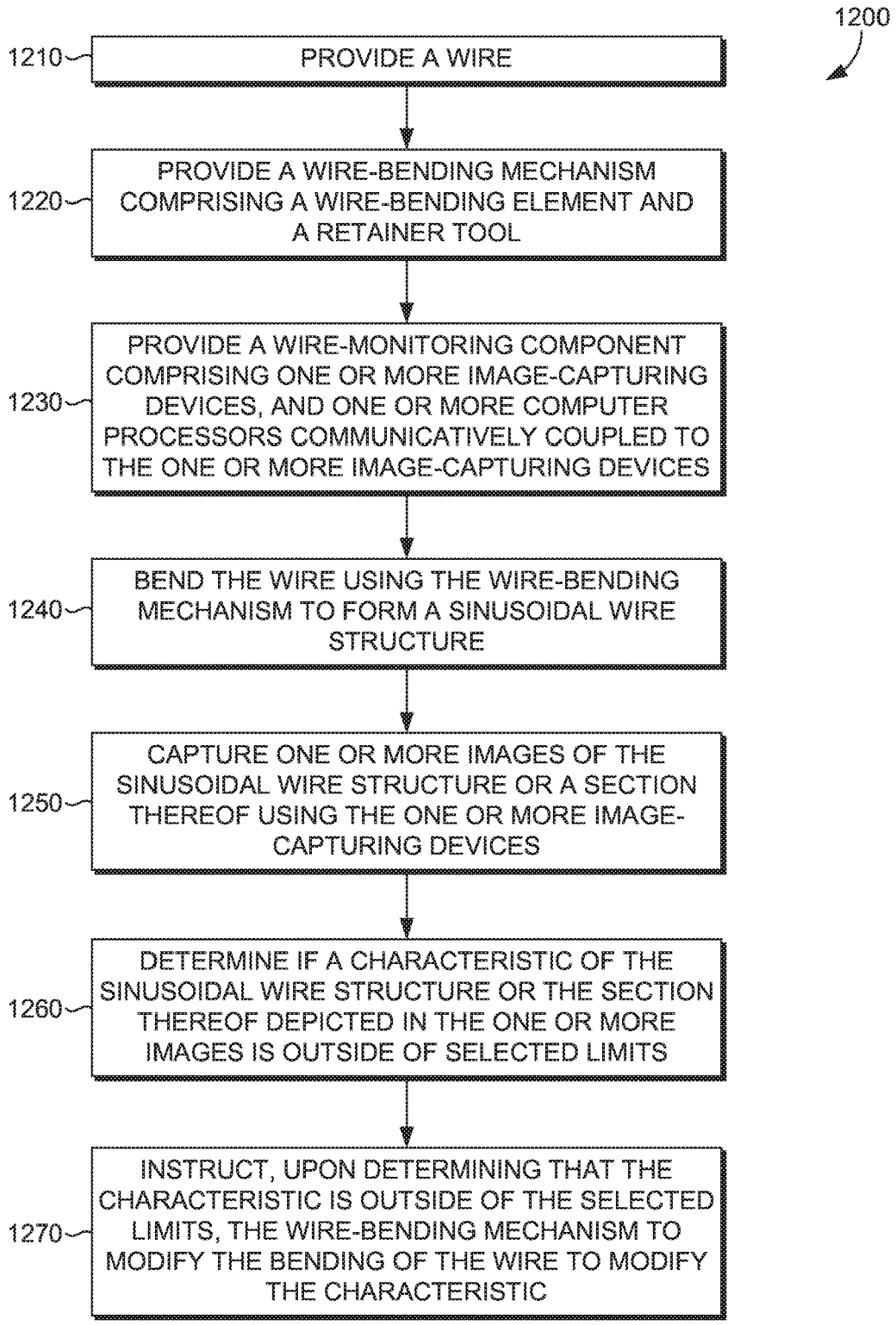
FIG. 12 depicts a block diagram of a second exemplary method of feedback-based wire bending, in accordance with an embodiment of the present technology.

Referring to FIG. 12, a block diagram of an exemplary method 1200 of feedback-based wire bending is provided, in accordance with an embodiment of the present technology. At a block 1210, a wire, such as the wire 24 shown in FIG. 2, is provided. At a block 1220, a wire-bending mechanism, such as the wire-bending mechanism 26 shown in FIG. 2, comprising a wire-bending element, such as the wire-bending element 56 shown in FIG. 5, and a retainer tool, such as the retainer tool 58 shown in FIG. 5, is provided. At a block 1230, a wire-monitoring component, such as the wire-monitoring component 36 shown in FIG. 2, comprising one or more image-capturing devices, such as the image-capturing device 38 shown in FIG. 8A, and one or more computer processors, such as the one or more computer processors 45 shown in FIG. 2, is provided. At a block 1240, the wire is bent using the wire-bending mechanism to form a sinusoidal wire structure, such as the sinusoidal wire structure 28 shown in FIG. 4. At a block 1250, one or more images of the sinusoidal wire structure or a section thereof, such as the discrete section 34 shown in FIG. 8A, are captured using the one or more image-capturing devices. At a block 1260, it is determined if a characteristic of the sinusoidal wire structure or the section thereof depicted in the one or more images is outside of selected limits. At a block 1270, an instruction is provided to the wire-bending mechanism to modify the bending of the wire to modify the characteristic when it is determined that the characteristic is outside of predetermined limits.

From the foregoing, it will be seen that the technology is one well adapted to attain all the ends and objects hereinabove set forth together with other advantages, which are obvious and which are inherent to the structure. It will be understood that certain features and sub-combinations are of utility and may be employed without reference to other features and sub-combinations. This is contemplated by and is within the scope of the claims.

The invention claimed is:

1. A feedback-based system for bending wire, the system comprising:

a wire-bending mechanism configured to bend a wire using continuous oscillation of a wire-bending element to produce a sinusoidal wire structure;

a wire-cutting mechanism configured to cut the sinusoidal wire structure into a plurality of sections;

a wire-monitoring component configured to:

detect a characteristic of the sinusoidal wire structure, determine if the characteristic is within selected limits, and provide an instruction to the wire-bending mechanism to modify the bending of the wire when the characteristic is not within the selected limits in order to modify the characteristic;

a pair of forming pins coupled to the wire-bending element, each one of the forming pins comprising a tapered profile; and a retainer tool configured to move between a first position for bracing the wire and a second position for releasing the wire during formation of the sinusoidal wire structure.

2. The system of claim 1, wherein the wire-bending mechanism further comprises a rotational actuator coupled to the wire-bending element for providing the oscillation.

3. The system of claim 2, further comprising:

a wire pre-tensioning device comprising a plurality of rollers through which the wire travels prior to reaching the wire-bending mechanism; and a shuttle through which the wire travels prior to reaching the wire-bending mechanism, the shuttle providing an oscillating motion to align the wire in a desired direction during the wire bending.

4. The system of claim 3, wherein modifying the bending of the wire to modify the characteristic comprises modifying, in response to the instruction, at least one of:

the wire-bending element or the pair of forming pins thereof;

the retainer tool or a component thereof;

the wire pre-tensioning device or a component thereof; and the shuttle or a component thereof.

5. The system of claim 4, wherein modifying the bending of the wire is performed automatically in response to the instruction.

6. The system of claim 4, wherein modifying the bending of the wire comprises modifying a vertical position of the pair of forming pins relative to the wire, such that a diameter of each of the pair of forming pins in contact with the wire during formation of the sinusoidal wire structure is adjusted.

7. The system of claim 1, further comprising one or more computer-readable media configured to store and access preconfigured system configurations, wherein the preconfigured system configurations are usable to generate a selected sinusoidal wire structure by modifying the bending of the wire to produce the selected sinusoidal wire structure.

8. The system of claim 1, wherein the wire-monitoring component comprises one or more image-capturing devices for capturing one or more images of the sinusoidal wire structure, the one or more images depicting the characteristic.

9. The system of claim 8, wherein the wire-monitoring component further comprises one or more computer-readable media having computer-executable instructions embodied thereon that, when executed, perform a method comprising:

determining if the characteristic is within the selected limits based on the one or more images from the one or more image-capturing devices; and upon determining that the characteristic is not within the selected limits, providing the instruction to modify the bending of the wire to modify the characteristic, wherein the one or more computer-readable media are communicatively coupled to the one or more image-capturing devices.

10. The system of claim 9, wherein the wire-monitoring component further comprises:

a receiving panel configured to individually receive each of the plurality of sections of the sinusoidal wire structure for image capture by the one or more image-capturing devices; and a backlight for selectively illuminating the receiving panel.

11. The system of claim 1, wherein the characteristic is at least one of:

a distance between points on adjacent sinusoidal curves of the sinusoidal wire structure;

a distance between points on a common sinusoidal curve of the sinusoidal wire structure;

a radius or diameter of at least one sinusoidal curve of the sinusoidal wire structure; and a shape of the sinusoidal wire structure.

12. The system of claim 1, further comprising a spring-forming mechanism configured to bend each of the plurality of sections of the sinusoidal wire structure into a respective circumferentially shaped spring.

13. A feedback-based method of bending wire, the method comprising:

providing a wire;

bending the wire using continuous oscillation of a wire-bending element to produce a sinusoidal wire structure;

detecting, using a wire-monitoring component, a characteristic of the sinusoidal wire structure;

determining, using the wire-monitoring component, if the characteristic is within selected limits; and providing, using the wire-monitoring component, an instruction to modify the bending of the wire to adjust the characteristic of the sinusoidal wire structure when the characteristic is not within the selected limits, wherein the wire-bending element comprises a pair of forming pins each having a tapered profile, and wherein bending the wire further comprises moving a retainer tool between a first position to retain the wire and a second position to release the wire during formation of the sinusoidal wire structure.

14. The method of claim 13, further comprising:

cutting, using a wire-cutting mechanism, the sinusoidal wire structure into a plurality of sections; and capturing, using one or more image-capturing devices in communication with the wire-monitoring component, one or more images of the sinusoidal wire structure or a cut section thereof, the one or more images depicting the characteristic.

15. The method of claim 13, wherein modifying the bending of the wire comprises modifying at least a vertical position of the pair of forming pins relative to the wire to adjust the characteristic of the sinusoidal wire structure.

16. The method of claim 13, wherein the characteristic comprises at least one of:

a distance between points on adjacent sinusoidal curves of the sinusoidal wire structure;

a distance between points on a common sinusoidal curve of the sinusoidal wire structure;

a radius or diameter of at least one sinusoidal curve of the sinusoidal wire structure; and a shape of the sinusoidal wire structure.

17. The method of claim 13, further comprising:

cutting the sinusoidal wire structure into a plurality of sections; and bending, using a spring-forming mechanism, the plurality of sections into a plurality of respective circumferentially shaped springs.

18. A method of feedback-based wire bending, the method comprising:

providing a wire;

providing a wire-bending mechanism comprising:

a wire-bending element comprising a pair of forming pins each having a tapered profile, and a retainer tool;

providing a wire-monitoring component comprising:

one or more image-capturing devices, and one or more computer processors communicatively coupled to the one or more image-capturing devices;

bending the wire using the wire-bending mechanism to form a sinusoidal wire structure;

capturing one or more images of the sinusoidal wire structure or a section thereof using the one or more image-capturing devices;

determining if a characteristic of the sinusoidal wire structure or the section thereof depicted in the one or more images is outside of selected limits; and instructing, upon determining that the characteristic is outside of the selected limits, the wire-bending mechanism to modify the bending of the wire to modify the characteristic, wherein bending the wire comprises moving the retainer tool between a first position to retain the wire and a second position to release the wire during formation of the sinusoidal wire structure.

19. The method of claim 18, wherein modifying the bending of the wire comprises adjusting at least one of the wire-bending element or a component thereof and the retainer tool or a component thereof, and wherein the characteristic comprises at least one of:

a distance between points on adjacent sinusoidal curves of the sinusoidal wire structure;

a distance between points on a common sinusoidal curve of the sinusoidal wire structure;

a radius or diameter of at least one sinusoidal curve of the sinusoidal wire structure; and a shape of the sinusoid wire structure.

* * * * *